US009378693B2

(12) United States Patent
Kim

(10) Patent No.: US 9,378,693 B2
(45) Date of Patent: Jun. 28, 2016

(54) DISPLAY PANEL, FLAT PANEL DISPLAY DEVICE HAVING THE SAME, AND METHOD OF DRIVING A DISPLAY PANEL

(71) Applicant: Samsung Display Co., Ltd., Yongin, Gyeonggi-do (KR)

(72) Inventor: Jin-Woo Kim, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 77 days.

(21) Appl. No.: 13/892,038

(22) Filed: May 10, 2013

(65) Prior Publication Data

US 2014/0009447 A1 Jan. 9, 2014

(30) Foreign Application Priority Data

Jul. 5, 2012 (KR) ..... 10-2012-0073143

(51) Int. Cl.
*G09G 3/36* (2006.01)

(52) U.S. Cl.
CPC ..... *G09G 3/3611* (2013.01); *G09G 3/3666* (2013.01); *G09G 2310/0202* (2013.01); *G09G 2330/025* (2013.01)

(58) Field of Classification Search
CPC . G09G 3/3611; G09G 3/3644; G09G 3/3666; G09G 2310/0202
See application file for complete search history.

(56) References Cited

U.S. PATENT DOCUMENTS

| | | | | |
|---|---|---|---|---|
| 6,104,370 | A * | 8/2000 | Nakagaki et al. | 345/100 |
| 6,535,193 | B1 * | 3/2003 | Mizutome et al. | 345/99 |
| 6,583,775 | B1 * | 6/2003 | Sekiya et al. | 345/76 |
| 2002/0044127 | A1 * | 4/2002 | Uchino et al. | 345/98 |
| 2007/0139355 | A1 * | 6/2007 | Ryuh et al. | 345/103 |
| 2008/0024418 | A1 * | 1/2008 | Kim | 345/98 |
| 2009/0115707 | A1 | 5/2009 | Park et al. | |

FOREIGN PATENT DOCUMENTS

| | | | |
|---|---|---|---|
| KR | 10-2007-0113917 | A | 11/2007 |
| KR | 10-2007-0122253 | A | 12/2007 |
| KR | 10-2009-0046403 | A | 5/2009 |

* cited by examiner

*Primary Examiner* — Latanya Bibbins
(74) *Attorney, Agent, or Firm* — Knobbe, Martens, Olson & Bear, LLP

(57) ABSTRACT

A display panel with multiple pixel circuit regions and separate scan lines is disclosed. One aspect is a display panel of a flat panel display device that includes left pixel circuits arranged in a left region of the display panel, right pixel circuits arranged in a right region of the display panel, left scan-lines coupled to the left pixel circuits, the left scan-lines transmitting a first scan signal to the left pixel circuits, right scan-lines coupled to the right pixel circuits, the right scan-lines transmitting a second scan signal to the right pixel circuits, and data-lines coupled to the left pixel circuits and the right pixel circuits, the data-lines transmitting a data signal to the left pixel circuits and the right pixel circuits. Here, the first scan signal and the second scan signal are transmitted to the left pixel circuits and the right pixel circuits constituting each horizontal-line via the left scan-lines and the right scan-lines with at least one predetermined time delay.

9 Claims, 16 Drawing Sheets

DISPLAY PANEL, FLAT PANEL DISPLAY DEVICE HAVING THE SAME, AND METHOD OF DRIVING A DISPLAY PANEL

CROSS-REFERENCE TO RELATED APPLICATIONS

This application claims priority under 35 USC §119 to Korean Patent Applications No. 10-2012-0073143, filed on Jul. 5, 2012 in the Korean Intellectual Property Office (KIPO), the contents of which are incorporated herein in its entirety by reference.

BACKGROUND

1. Field

The disclosed technology generally relates to a display device. More particularly, the disclosed technology relates to a display panel having multiple display circuit regions driven by separately timed scan signals, a flat panel display device having the same, and a method of driving a display panel.

2. Description of the Related Technology

Recently, liquid crystal display (LCD) and an organic light emitting diode (OLED) display technologies have been widely used in commercial flat panel displays. Generally, a display panel, that contains the pixel circuits and driving circuits of the flat panel display device, a plurality of scan-lines for transmitting a scan signal is arranged in a first direction, a plurality of data-lines for transmitting a data signal is arranged in a second direction, and a plurality of pixel circuits is arranged at locations corresponding to crossing points of the scan-lines and the data-lines. Thus, the flat panel display device may display one frame by sequentially applying the scan signal to the scan-lines and by simultaneously applying the data signal to the data-lines.

As described above, the flat panel display device simultaneously performs a data writing operation for the pixel circuits constituting one horizontal-line (i.e., coupled to one scan-line). For this reason, a wide range of data signal should be provided to capacitors of the pixel circuits constituting each horizontal-line (i.e., alternately charged and discharged) when the flat panel display device displays one frame having a horizontal stripe pattern (e.g., black color data and white color data are alternately input along horizontal-lines). As a result, a peak current may occur in the data driving unit. Peak current may result in electro-magnetic interference (EMI), noise, stress on components, and other deleterious effects.

SUMMARY OF CERTAIN INVENTIVE ASPECTS

Some example embodiments provide a display panel capable of preventing a peak current from occurring when a wide range of data signal is provided to capacitors of pixel circuits constituting each horizontal-line.

Some example embodiments provide a flat panel display device having the display panel.

Some example embodiments provide a method of driving the display panel.

According to some example embodiments, a display panel of a flat panel display device, the display panel comprising: a plurality of left pixel circuits arranged in a left region of the display panel, a plurality of right pixel circuits arranged in a right region of the display panel, a plurality of left scan-lines coupled to the left pixel circuits, the left scan-lines configured to transmit a first scan signal to the left pixel circuits, a plurality of right scan-lines coupled to the right pixel circuits, the right scan-lines configured to transmit a second scan signal to the right pixel circuits, and a plurality of data-lines coupled to the left pixel circuits and the right pixel circuits, the data-lines configured to transmit a data signal to the left pixel circuits and the right pixel circuits. Here, the first scan signal and the second scan signal are transmitted to the left pixel circuits and the right pixel circuits constituting each horizontal-line via the left scan-lines and the right scan-lines with at least one predetermined time delay.

In example embodiments, the predetermined time delay corresponds to a time delay of ½ horizontal period.

In example embodiments, the first scan signal is sequentially applied to the left scan-lines at a time interval of one horizontal period.

In example embodiments, the second scan signal is sequentially applied to the right scan-lines at a time interval of one horizontal period.

In example embodiments, the flat panel display device corresponds to an organic light emitting display (OLED) device.

In example embodiments, the flat panel display device corresponds to a liquid crystal display (LCD) device.

According to some example embodiments, a flat panel display device, comprising: a display panel having a plurality of left pixel circuits arranged in a left region of the display panel and a plurality of right pixel circuits arranged in a right region of the display panel, a left scan driving unit configured to provide a first scan signal to the left pixel circuits via a plurality of left scan-lines coupled to the left pixel circuits, a right scan driving unit configured to provide a second scan signal to the right pixel circuits via a plurality of right scan-lines coupled to the right pixel circuits, a data driving unit configured to provide a data signal to the left pixel circuits and the right pixel circuits via a plurality of data-lines coupled to the left pixel circuits and the right pixel circuits, and a timing control unit configured to control the left scan driving unit, the right scan driving unit, and the data driving unit wherein the left scan driving unit and the right scan driving unit provide the first scan signal and the second scan signal to the display panel with at least one predetermined time delay.

In example embodiments, the predetermined time delay corresponds to a time delay of ½ horizontal period.

In example embodiments, the left scan driving unit sequentially applies the first scan signal to the left scan-lines at a time interval of one horizontal period.

In example embodiments, the right scan driving unit sequentially applies the second scan signal to the right scan-lines at a time interval of one horizontal period.

In example embodiments, the flat panel display device corresponds to an organic light emitting display (OLED) device.

In example embodiments, the flat panel display device corresponds to a liquid crystal display (LCD) device.

According to some example embodiments, a method of driving a display panel comprising: providing a second scan signal to right pixel circuits coupled to a (k)th right scan-line, where k is an integer equal to or greater than 1, with a time delay of ½ horizontal period after a first scan signal is provided to left pixel circuits coupled to a (k)th left scan-line, and providing the second scan signal to right pixel circuits coupled to a (k+1)th right scan-line with the time delay of ½ horizontal period after the first scan signal is provided to left pixel circuits coupled to a (k+1)th left scan-line.

In example embodiments, the first scan signal is applied to the (k+1)th left scan-line with the time delay of ½ horizontal period when the second scan signal is applied to the (k)th right scan-line.

In example embodiments, the first scan signal is applied to the (k+1)th left scan-line with a time delay of one horizontal period when the first scan signal is applied to the (k)th left scan-line.

In example embodiments, the second scan signal is applied to the (k+1)th right scan-line with a time delay of one horizontal period when the second scan signal is applied to the (k)th right scan-line.

According to some example embodiments, a method of driving a display panel, the method comprising: providing a first scan signal to left pixel circuits coupled to a (k)th left scan-line, where k is an integer equal to or greater than 1, with a time delay of ½ horizontal period after a second scan signal is provided to right pixel circuits coupled to a (k)th right scan-line, and providing the first scan signal to left pixel circuits coupled to a (k+1)th left scan-line with the time delay of ½ horizontal period after the second scan signal is provided to right pixel circuits coupled to a (k+1)th right scan-line.

In example embodiments, the second scan signal is applied to the (k+1)th right scan-line with the time delay of ½ horizontal period after the first scan signal is applied to the (k)th left scan-line.

In example embodiments, the first scan signal is applied to the (k+1)th left scan-line with a time delay of one horizontal period after the first scan signal is applied to the (k)th left scan-line.

In example embodiments, the second scan signal is applied to the (k+1)th right scan-line with a time delay of one horizontal period after the second scan signal is applied to the (k)th right scan-line.

Therefore, a display panel according to example embodiments may prevent a peak current from occurring when a wide range of data signal is provided to capacitors of pixel circuits (i.e., left pixel circuits and right pixel circuits), based on a structure in which the left pixel circuits are coupled to a left scan driving unit, the right pixel circuits are coupled to a right scan driving unit, and the left pixel circuits and the right pixel circuits constituting each horizontal-line are scanned with a time delay of ½ (i.e., half) horizontal period.

In addition, a flat panel display device having the display panel according to example embodiments may prevent an EMI, a noise, a stress on components, etc. due to a peak current occurring.

Further, a method of driving a display panel according to example embodiments control left pixel circuits and right pixel circuits constituting each horizontal-line to be scanned with a time delay of ½ horizontal period, where the left pixel circuit are coupled to a left scan driving unit, and the right pixel circuits are coupled to a right scan driving unit.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF CERTAIN INVENTIVE EMBODIMENTS

Figure 1:
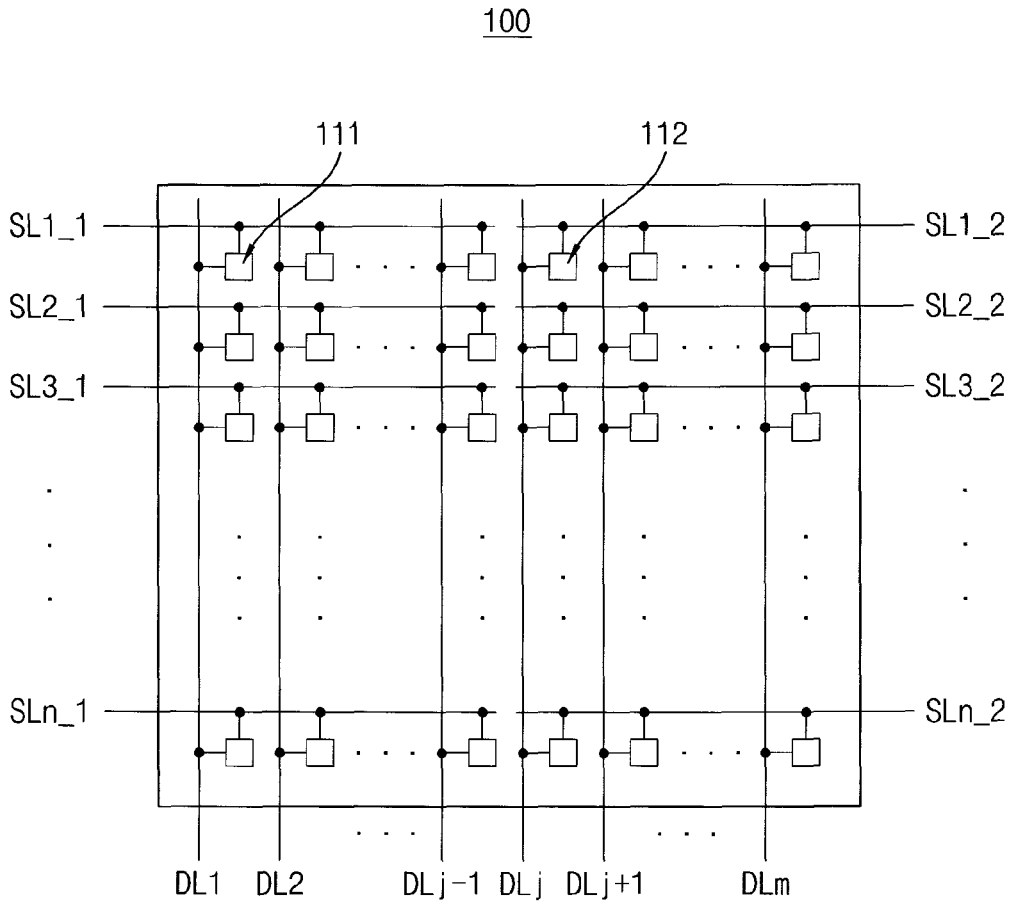
FIG. 1 is a diagram illustrating a display panel according to example embodiments.

Various example embodiments will be described more fully hereinafter with reference to the accompanying drawings, in which some example embodiments are shown. The present disclosed technology may, however, be embodied in many different forms and should not be construed as limited to the example embodiments set forth herein. Rather, these example embodiments are provided so that this disclosure will be thorough and complete, and will fully convey the scope of the present disclosed technology to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present disclosed technology. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present disclosed technology. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosed technology belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a diagram illustrating a display panel according to example embodiments.

Referring to embodiments as depicted in FIG. 1, the display panel 100 of a flat panel display device includes a plurality of left pixel circuits 111, a plurality of right pixel circuits 112, a plurality of left scan-lines SL1_1 through SLn_1, a plurality of right scan-lines SL1_2 through SLn_2, and a plurality of data-lines DL1 through DLm.

The left pixel circuits 111 are formed in a left region of the display panel 100. The left pixel circuits 111 are coupled to the left scan-lines SL1_1 through SLn_1 that are formed in a first direction (i.e., X-axis direction in FIG. 1) and the data-lines DL1 through DLj−1 that are formed in a second direction (i.e., Y-axis direction in FIG. 1). Hence, the left pixel circuits 111 are arranged in a matrix-shape at locations corresponding to crossing points of the left scan-lines SL1_1 through SLn_1 and the data-lines DL1 through DLj−1. The right pixel circuits 112 are formed in a right region of the display panel 100. The right pixel circuits 112 are coupled to the right scan-lines SL1_2 through SLn_2 that are formed in the first direction (i.e., X-axis direction in FIG. 1) and the data-lines DLj through DLm that are formed in the second direction (i.e., Y-axis direction in FIG. 1). Hence, the right pixel circuits 112 are arranged in a matrix-shape at locations corresponding to crossing points of the right scan-lines SL1_2 through SLn_2 and the data-lines DLj through DLm. Thus, the pixel circuits 111 and 112 are classified into either left pixel circuits 111 or right pixel circuits 112 based on their respective locations in the display panel 110. Therefore, the left pixel circuits 111 and the right pixel circuits 112 will generally have substantially the same structure.

The left scan-lines SL1_1 through SLn_1 are coupled to the left pixel circuits 111. Thus, the left scan-lines SL1_1 through SLn_1 transmit a first scan signal to the left pixel circuits 111. The first scan signal are sequentially provided to the left scan-lines SL1_1 through SLn_1 at a time interval of one horizontal period. For example, when the first scan signal is provided to the left pixel circuits 111 coupled to the first left scan-line SL1_1, the first scan signal are provided to the left pixel circuits 111 coupled to the second left scan-line SL2_1 after one horizontal period. Similarly, when the first scan signal is provided to the left pixel circuits 111 coupled to the second left scan-line SL2_1, the first scan signal is provided to the left pixel circuits 111 coupled to the third left scan-line SL3_1 after one horizontal period. That is, the first scan signal is the scan signal for driving the left pixel circuits 111 coupled to the left scan-lines SL1_1 through SLn_1. When the first scan signal is provided to the left pixel circuits 111, the data signal is provided to the left pixel circuits 111 via the data-lines DL1 through DLj−1.

The right scan-lines SL1_2 through SLn_2 are coupled to the right pixel circuits 112. Thus, the right scan-lines SL1_2 through SLn_2 transmit a second scan signal to the right pixel circuits 112. The second scan signal are sequentially provided to the right scan-lines SL1_2 through SLn_2 at a time interval of one horizontal period. For example, when the second scan signal is provided to the right pixel circuits 112 coupled to the first right scan-line SL1_2, the second scan signal is provided to the right pixel circuits 112 coupled to the second right scan-line SL2_2 after one horizontal period. Similarly, when the second scan signal is provided to the right pixel circuits 112 coupled to the second right scan-line SL2_1, the second scan signal is provided to the right pixel circuits 112 coupled to the third right scan-line SL3_2 after one horizontal period. That is, the second scan signal is the scan signal for driving the right pixel circuits 112 coupled to the right scan-lines SL1_2 through SLn_2. When the second scan signal is provided to the right pixel circuits 112, the data signal is provided to the right pixel circuits 112 via the data-lines DLj through DLm. Although the scan signal is classified in these embodiments into either of a first scan signal or a second scan signal, the first scan signal and the second scan signal will generally have substantially the same shape.

The data-lines DL1 through DLm are coupled to the left pixel circuits 111 and the right pixel circuits 112. Thus, the data-lines DL1 through DLm transmit the data signal to the left pixel circuits 111 and the right pixel circuits 112. Specifically, the data-lines DL1 through DLm are classified into the data-lines DL1 through DLj−1 coupled to the left pixel circuits 111 and the data-lines DLj through DLm coupled to the right pixel circuits 112. The scan-lines are not divided into left scan-lines and right scan-lines in conventional display panels, whereas in embodiments configured according to FIG. 1, for example, the scan-lines are divided into the left scan-lines SL1_1 through SLn_1 and the right scan-lines SL1_2 through SLn_2 in the display panel 100. That is, in conventional display panels, a data writing operation is simultaneously performed for all of the pixel circuits constituting one horizontal-line. For this reason, when one frame having a horizontal stripe pattern is displayed (e.g., black color data and white color data are alternately input along horizontal-lines), a wide range of data signal levels is provided to capacitors of the pixel circuits constituting each horizontal-line (i.e., alternately charged and discharged). As a result, a peak current may occur in the data driving unit of conventional display panels thus causing undesirable effects such as EMI, noise, electromechanical stress on components, etc.

Therefore, in the display panel 100, the left pixel circuits 111 are coupled to the left scan driving unit via the left scan-lines SL1_1 through SLn_1, and the right pixel circuits 112 are coupled to the right scan driving unit via the right scan-lines SL1_2 through SLn_2. On this basis, the first scan signal and the second scan signal are provided to respective horizontal-lines with a predetermined time delay. Here, the predetermined time delay may be a time delay of ½ horizontal period. The first scan signal is sequentially provided to the left scan-lines SL1_1 through SLn_1 at a time interval of one horizontal period. The second scan signal is sequentially provided to the right scan-signals SL1_2 through SLn_2 at a time interval of one horizontal period. In other words, the left scan driving unit and the right scan driving unit provide the first scan signal and the second scan signal to the left pixel circuits 111 and the right pixel circuits 112 constituting each horizontal-line with a time delay of ½ horizontal period. As a result, the data signal is not simultaneously provided to the left pixel circuits 111 and the right pixel circuits 112 constituting a given horizontal-line.

In one example embodiment, when the left scan driving unit provides the first scan signal to the left pixel circuits 111 coupled to a first left scan-line SL1_1 via the first left scan-line SL1_1, the right scan driving unit may provide the second scan signal to the right pixel circuits 112 coupled to a first right scan-line SL1_2 via the first right scan-line SL1_2 after ½ horizontal period. As described above, the left scan driving unit sequentially provides the first scan signal to the left scan-lines SL1_1 through SLn_1 at a time interval of one horizontal period. Thus, when the second scan signal is provided to the right pixel circuits 112 coupled to the first right scan-line SL1_2, the left scan driving unit may provide the first scan signal to the left pixel circuits 111 coupled to a second left scan-line SL2_1 via the second left scan-line SL2_1 after ½ horizontal period. Similarly, when the first scan signal is provided to the left pixel circuits 111 coupled to the second left scan-line SL2_1, the right scan driving unit may provide the second scan signal to the right pixel circuits 112 coupled to a second right scan-line SL2_2 via the second right scan-line SL2_2 after ½ horizontal period. Accordingly, in the display panel 100, the data signal is not simultaneously provided to the left pixel circuits 111 and the right pixel circuits 112 constituting a given horizontal-line. As a result, the display panel 100 substantially prevents peak current from occurring when a wide range of data signal levels is provided to capacitors of the pixel circuits 111 and 112 constituting each horizontal-line (i.e., alternately charged and discharged).

In another example embodiment, when the right scan driving unit provides the second scan signal to the right pixel circuits 112 coupled to a first right scan-line SL1_2 via the first right scan-line SL1_2, the left scan driving unit may provide the first scan signal to the left pixel circuits 111 coupled to a first left scan-line SL1_1 via the first left scan-line SL1_1 after ½ horizontal period. As described above, the right scan driving unit sequentially provides the second scan signal to the right scan-lines SL1_2 through SLn_2 at a time interval of one horizontal period. Thus, when the first scan signal is provided to the left pixel circuits 111 coupled to the first left scan-line SL1_1, the right scan driving unit may provide the second scan signal to the right pixel circuits 112 coupled to a second right scan-line SL2_2 via the second right scan-line SL2_2 after ½ horizontal period. Similarly, when the second scan signal is provided to the right pixel circuits 112 coupled to the second right scan-line SL2_2, the left scan driving unit may provide the first scan signal to the left pixel circuits 111 coupled to a second left scan-line SL2_1 via the second left scan-line SL2_1 after ½ horizontal period. Accordingly, in the display panel 100, the data signal is not simultaneously provided to the left pixel circuits 111 and the right pixel circuits 112 constituting a given horizontal-line. As a result, the display panel 100 substantially prevents the peak current from occurring when a wide range of data signal levels is provided to capacitors of the pixel circuits 111 and 112 constituting each horizontal-line.

As described above, the display panel 100 can have a structure in which the left pixel circuits 111 are coupled to the left scan driving unit, the right pixel circuits 112 are coupled to the right scan driving unit, and the left pixel circuits 111 and the right pixel circuits 112 constituting each horizontal-line are scanned with a time delay of ½ horizontal period. Hence, the display panel 100 can substantially prevent peak current from occurring when a wide range of data signal is provided to capacitors of the pixel circuits 111 and 112 constituting a given horizontal-line (i.e., alternately charged and discharged). As a result, even when one frame having a horizontal stripe pattern is displayed (e.g., black color data and white color data are alternately input along horizontal-lines), interference due to the peak current (e.g., EMI, noise, electromechanical stress on components, etc.) can be reduced. In one example embodiment, the display panel 100 may be a display panel included in an organic light emitting display (OLED) device. In this case, the pixel circuits (i.e., the left pixel circuits 111 and the right pixel circuits 112) of the display panel 100 may have respective organic light emitting diodes. In another example embodiment, the display panel 100 may be a display panel included in a liquid crystal display (LCD) device. In this case, the pixel circuits (i.e., the left pixel circuits 111 and the right pixel circuits 112) of the display panel 100 may have respective liquid crystal layers. Naturally, the type of light emitting technology used by the display panel 100 is not limited thereto.

Figure 2:
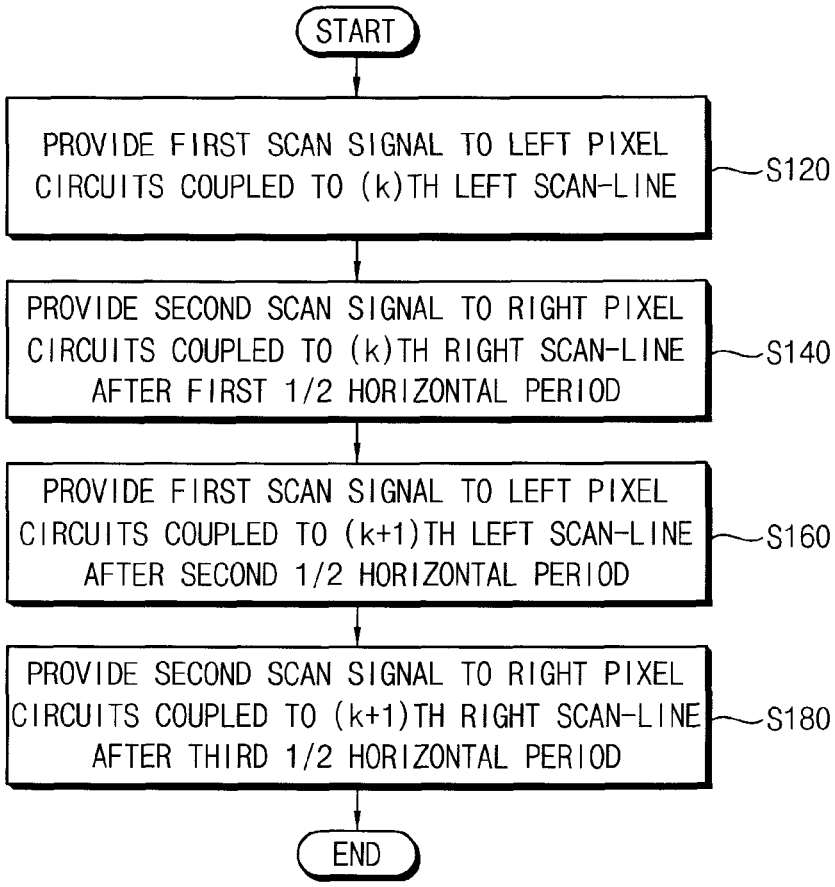
FIG. 2 is a flowchart illustrating an exemplary method of driving a display panel of FIG. 1.

FIG. 2 is a flowchart illustrating an exemplary method of driving a display panel of FIG. 1. FIGS. 3A through 3D are diagrams illustrating an example in which left pixel circuits and right pixel circuits constituting each horizontal-line are scanned by the method of FIG. 2.

Referring to FIG. 2, the method of FIG. 2 provides the first scan signal to the left pixel circuits 111 coupled to a (k)th left scan-line SLk_1 (Step S120), where k is an integer equal to or greater than 1, and then provides the second scan signal to the right pixel circuits 112 coupled to a (k)th right scan-line SLk_2 (Step S140) after ½ horizontal period. Subsequently, the method provides the first scan signal to the left pixel circuits 111 coupled to a (k+1)th left scan-line SLk+1_1 (Step S160) after ½ horizontal period, and then provides the second scan signal to the right pixel circuits 112 coupled to a (k+1)th right scan-line SLk+1_2 (Step S180) after ½ horizontal period. Thus, in the display panel 100, the data signal is not simultaneously provided to the left pixel circuits 111 and the right pixel circuits 112 constituting each horizontal-line. As a result, the method of FIG. 2 can substantially prevent peak current from occurring when a wide range of data signal levels is provided to capacitors of the left pixel circuits 111 and the right pixel circuits 112 constituting a given horizontal-line. Below, the above-described timed operation of the scan and data lines will be described in detail with reference to FIGS. 3A through 3D.

Figure 3A:
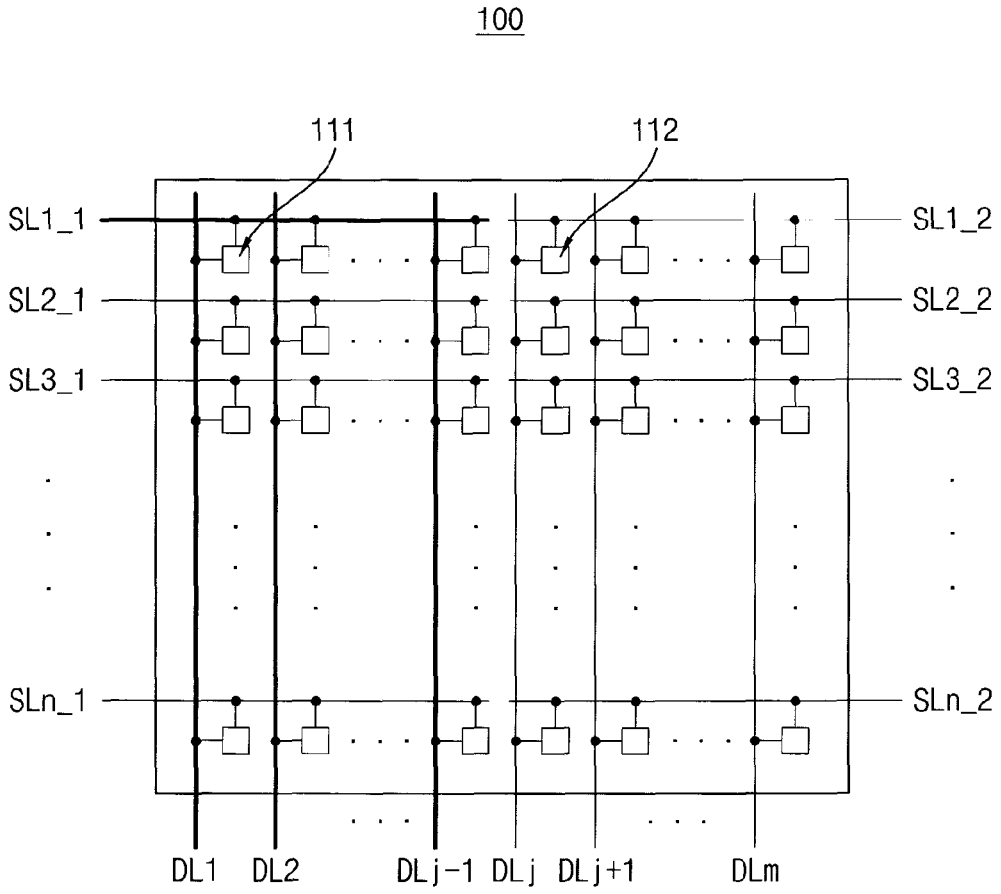
FIGS. 3A through 3D are diagrams illustrating an example in which left pixel circuits and right pixel circuits constituting each horizontal-line are scanned by a method of FIG. 2.
Figure 3B:
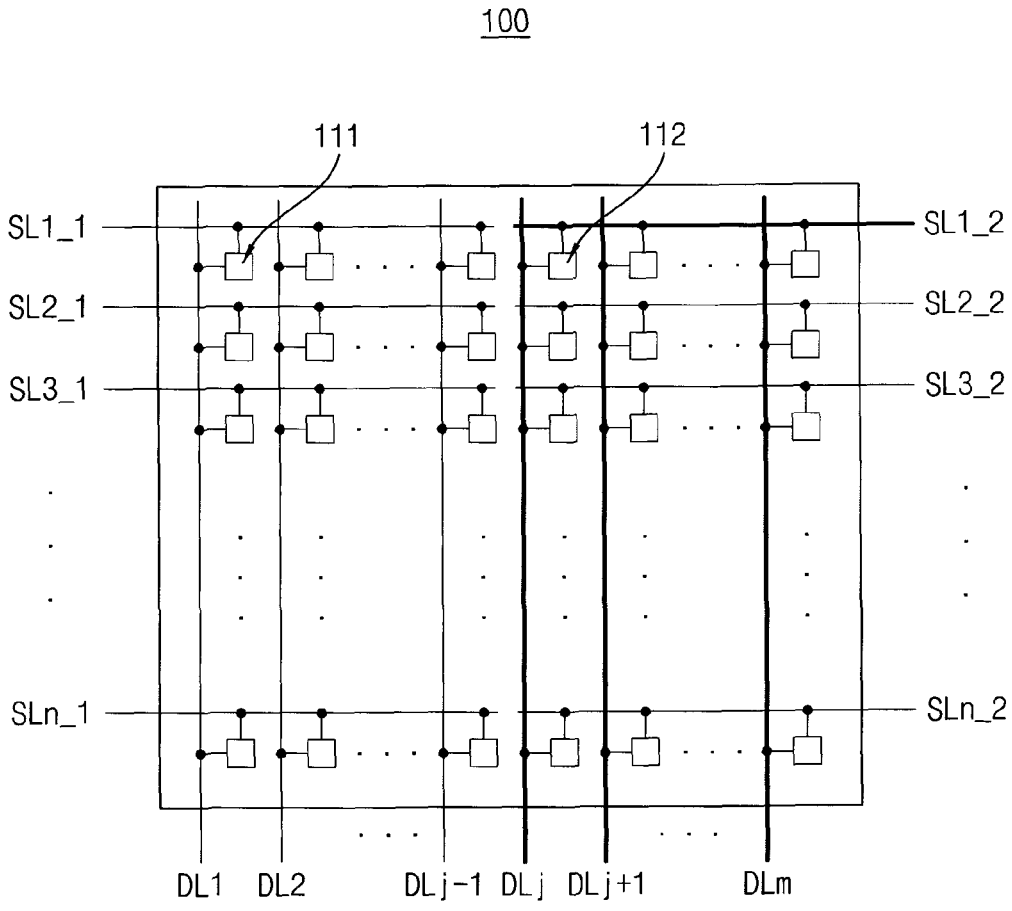
Figure 3C:
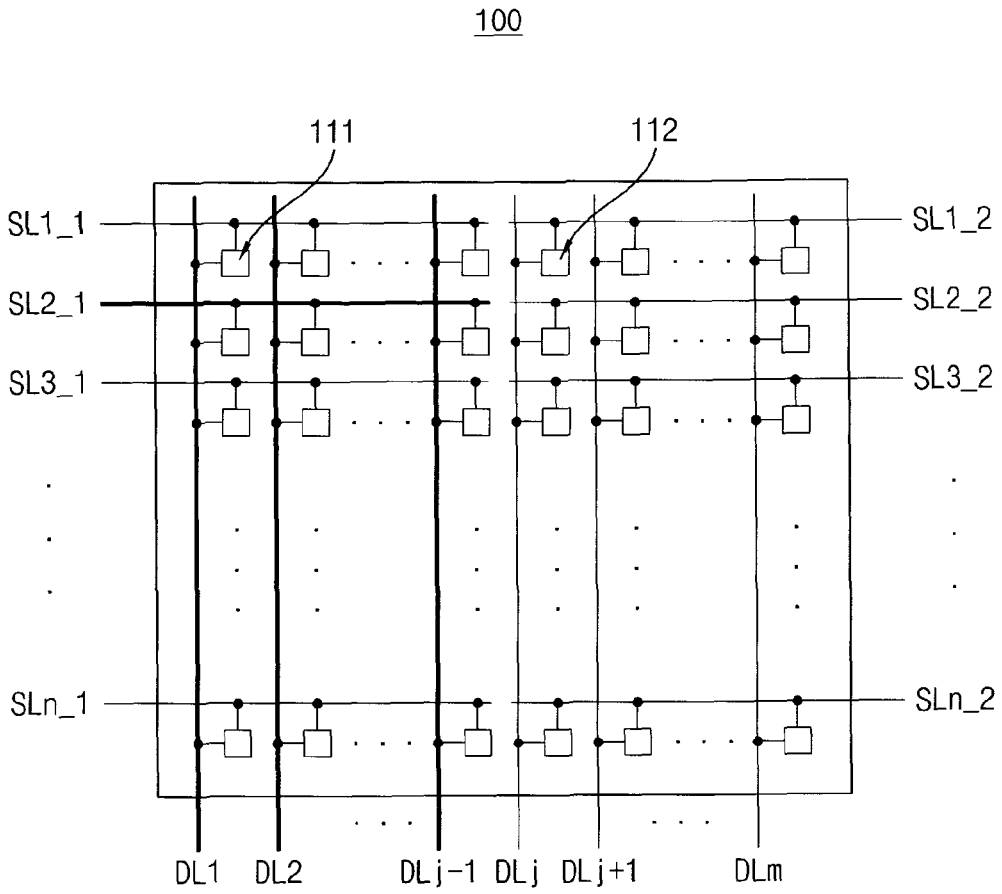
Figure 3D:
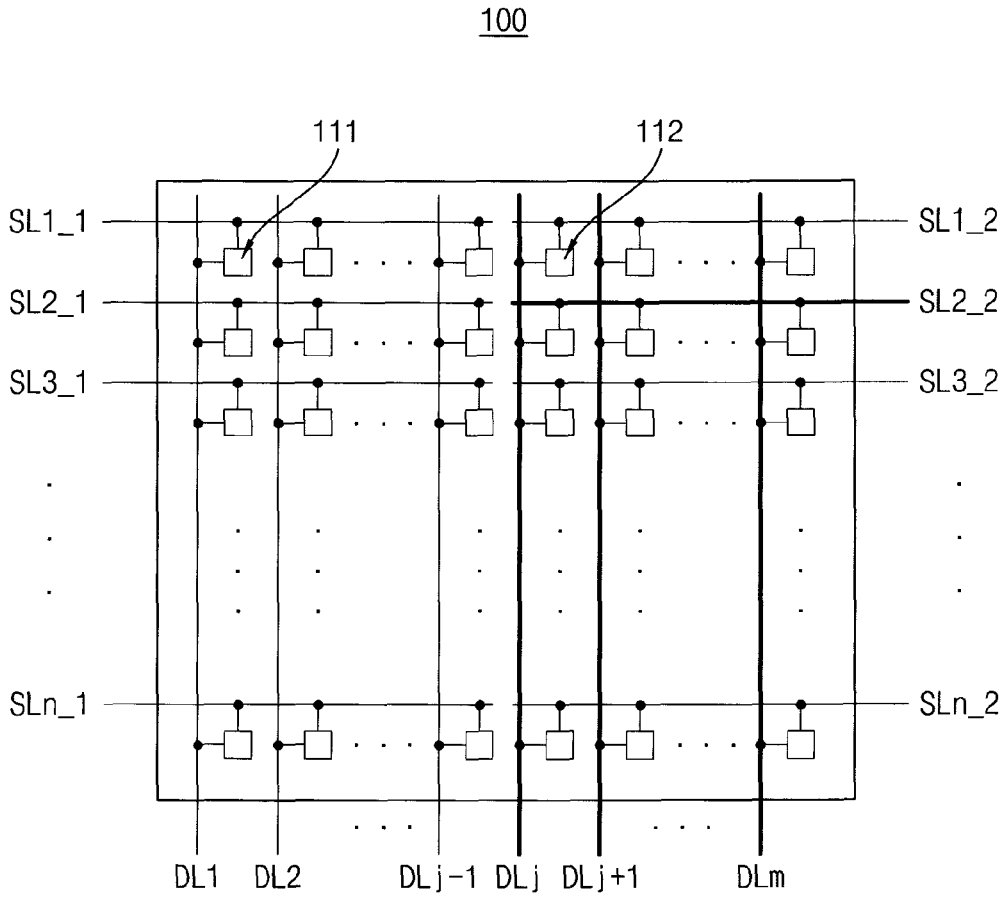

As illustrated in FIG. 3A, the left scan driving unit provides the first scan signal to the left pixel circuits 111 coupled to a first left scan-line SL1_1 via the first left scan-line SL1_1. Thus, the data signal is provided to the left pixel circuits 111 coupled to the first left scan-line SL1_1 via the data-lines DL1 through DLj−1. As illustrated in FIG. 3B, after ½ horizontal period, the right scan driving unit provides the second scan signal to the right pixel circuits 112 coupled to a first right scan-line SL1_2 via the first right scan-line SL1_2. Thus, the data signal is provided to the right pixel circuits 112 coupled to the first right scan-line SL1_2 via the data-lines DLj through DLm. By this operation, the data signal is applied to all pixel circuits 111 and 112 coupled to a first scan-line (i.e., the first left scan-line SL1_1 and the first right scan-line SL1_2) in the display panel 100. As described above, the left scan driving unit sequentially provides the first scan signal to the left scan-lines SL1_1 through SLn_1 at a time interval of one horizontal period. Thus, when the second scan signal is provided to the right pixel circuits 112 coupled to the first right scan-line SL1_2, as illustrated in FIG. 3C, the left scan driving unit provides the first scan signal to the left pixel circuits 111 coupled to a second left scan-line SL2_1 via the second left scan-line SL2_1 after a ½ horizontal period. Thus, the data signal is provided to the left pixel circuits 111 coupled to the second left scan-line SL2_1 via the data-lines DL1 through DLj−1. Subsequently, as illustrated in FIG. 3D, after ½ horizontal period, the right scan driving unit provides the second scan signal to the right pixel circuits 112 coupled to a second right scan-line SL2_2 via the second right scan-line SL2_2. Thus, the data signal is provided to the right pixel circuits 112 coupled to the second right scan-line SL2_2 via the data-lines DLj through DLm. By this operation, the data signal is applied to all pixel circuits 111 and 112 coupled to a second scan-line (i.e., the second left scan-line SL2_1 and the second right scan-line SL2_2) in the display panel 100. In this way, scan operations for all pixel circuits 111 and 112 can be completed during one frame.

Figure 4:
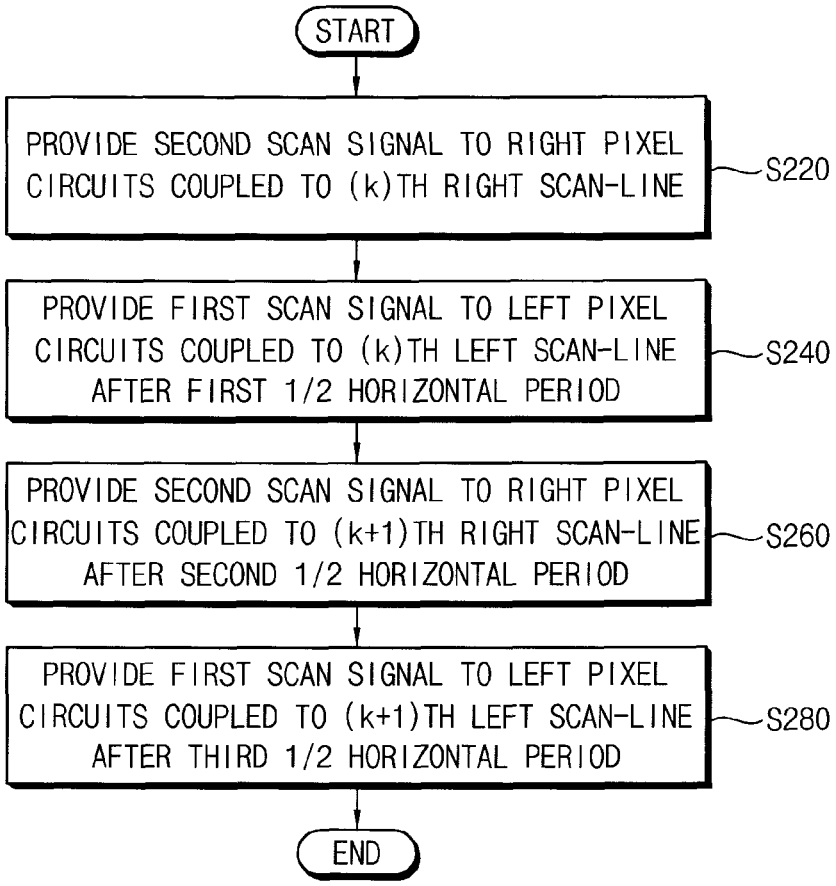
FIG. 4 is a flowchart illustrating another exemplary method of driving a display panel of FIG. 1.

FIG. 4 is a flowchart illustrating another exemplary method of driving the display panel embodiments of FIG. 1. FIGS. 5A through 5D are diagrams illustrating an example of time sequenced operation of scan and data lines in which left pixel circuits and right pixel circuits constituting each horizontal-line are scanned by the method of FIG. 4.

Referring to FIG. 4, the method of FIG. 4 provides the second scan signal to the right pixel circuits 112 coupled to a (k)th right scan-line SLk_2 (Step S220), where k is an integer equal to or greater than 1, and then provides the first scan signal to the left pixel circuits 111 coupled to a (k)th left scan-line SLk_1 (Step S240) after ½ horizontal period. Subsequently, the method of FIG. 4 provides the second scan signal to the right pixel circuits 112 coupled to a (k+1)th right scan-line SLk+1_2 (Step S260) after ½ horizontal period, and then provides the first scan signal to the left pixel circuits 111 coupled to a (k+1)th left scan-line SLk+1_1 (Step S280) after ½ horizontal period. Thus, in the display panel 100, the data signal is not simultaneously provided to the left pixel circuits 111 and the right pixel circuits 112 constituting each horizontal-line. As a result, the method of FIG. 4 prevents peak current from occurring when a wide range of data signal levels is provided to capacitors of the left pixel circuits 111 and the right pixel circuits 112 constituting each horizontal-line. Below, the above-described timed operation of the scan and data lines will be described in detail with reference to FIGS. 5A through 5D.

Figure 5A:
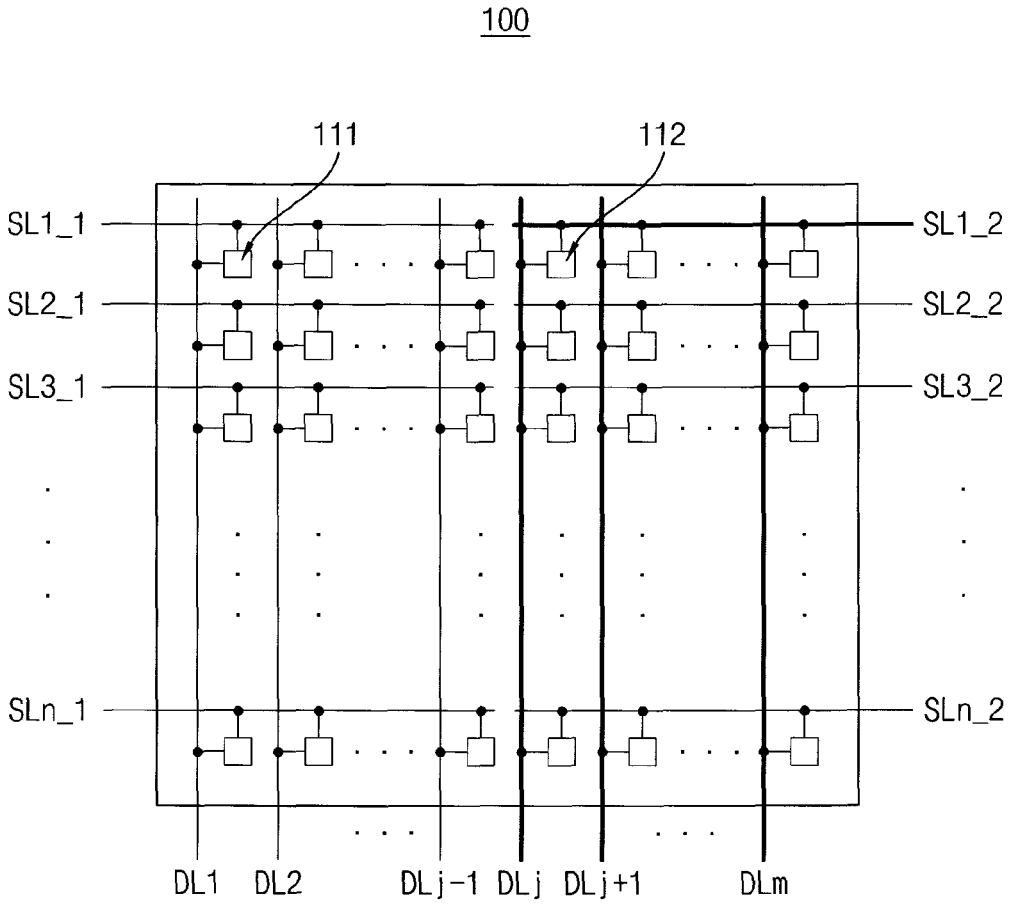
FIGS. 5A through 5D are diagrams illustrating an example in which left pixel circuits and right pixel circuits constituting each horizontal-line are scanned by a method of FIG. 4.
Figure 5B:
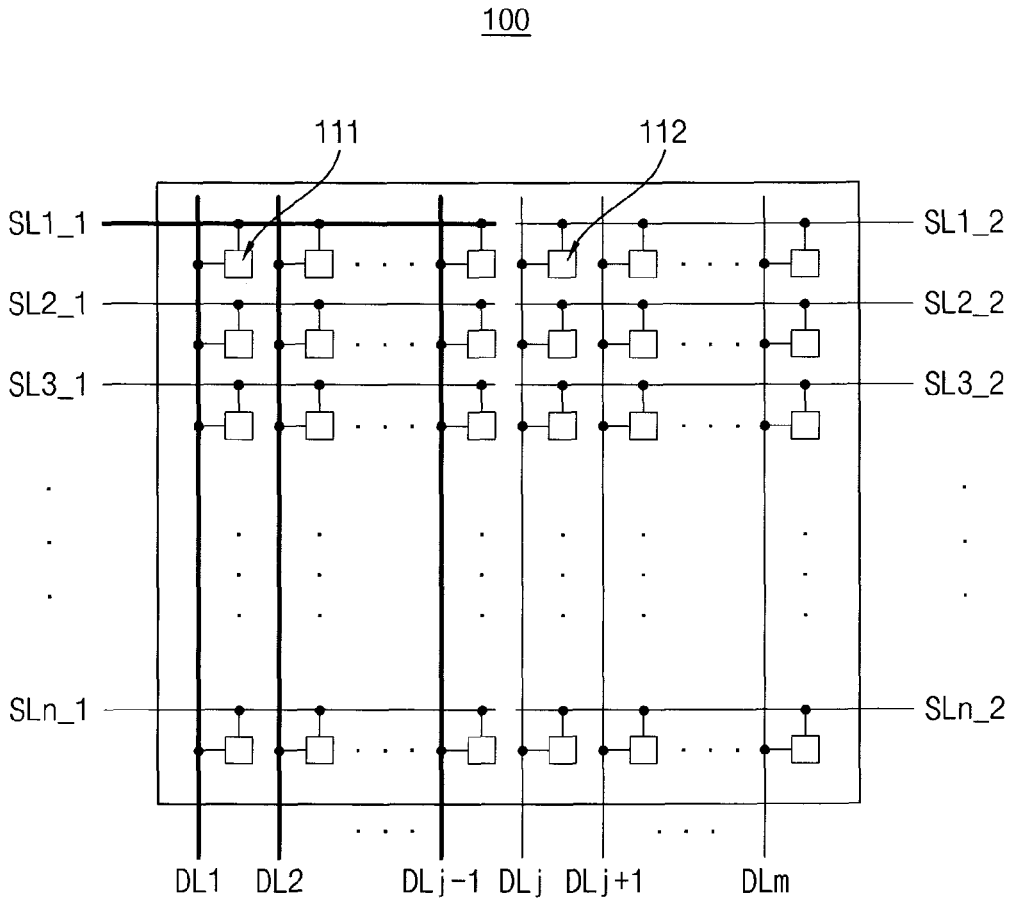
Figure 5C:
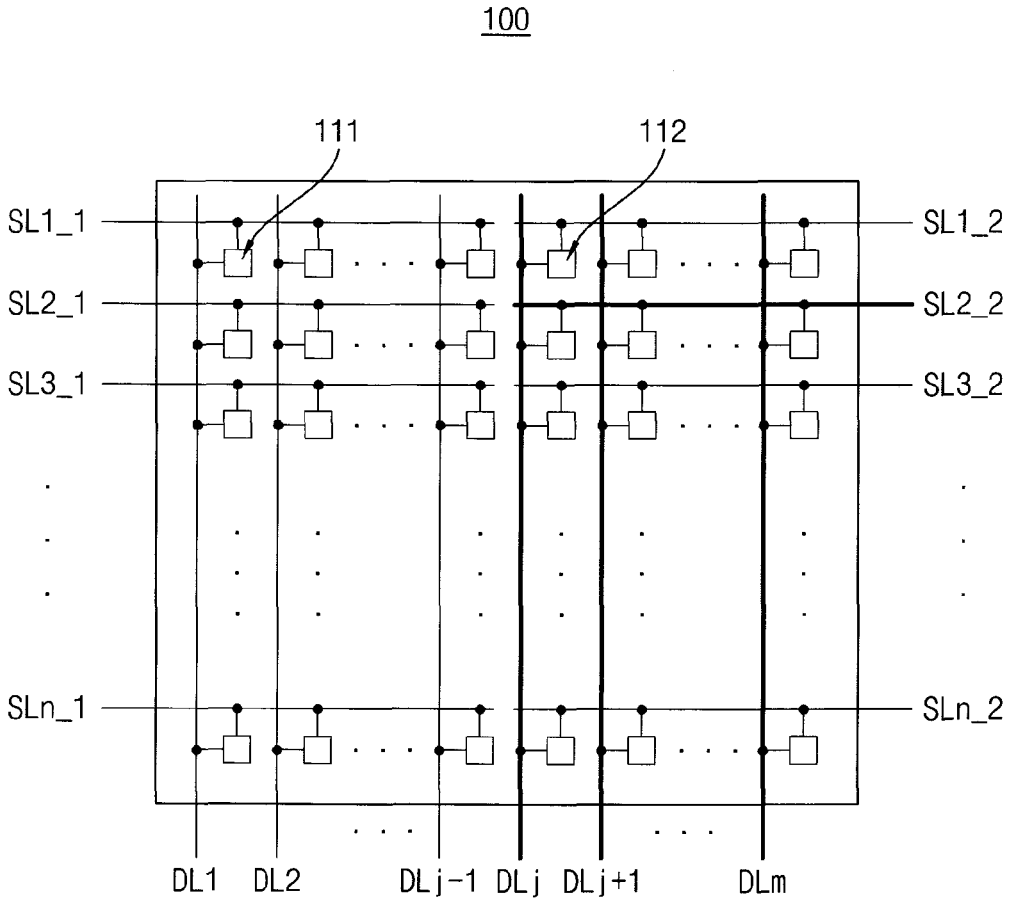
Figure 5D:
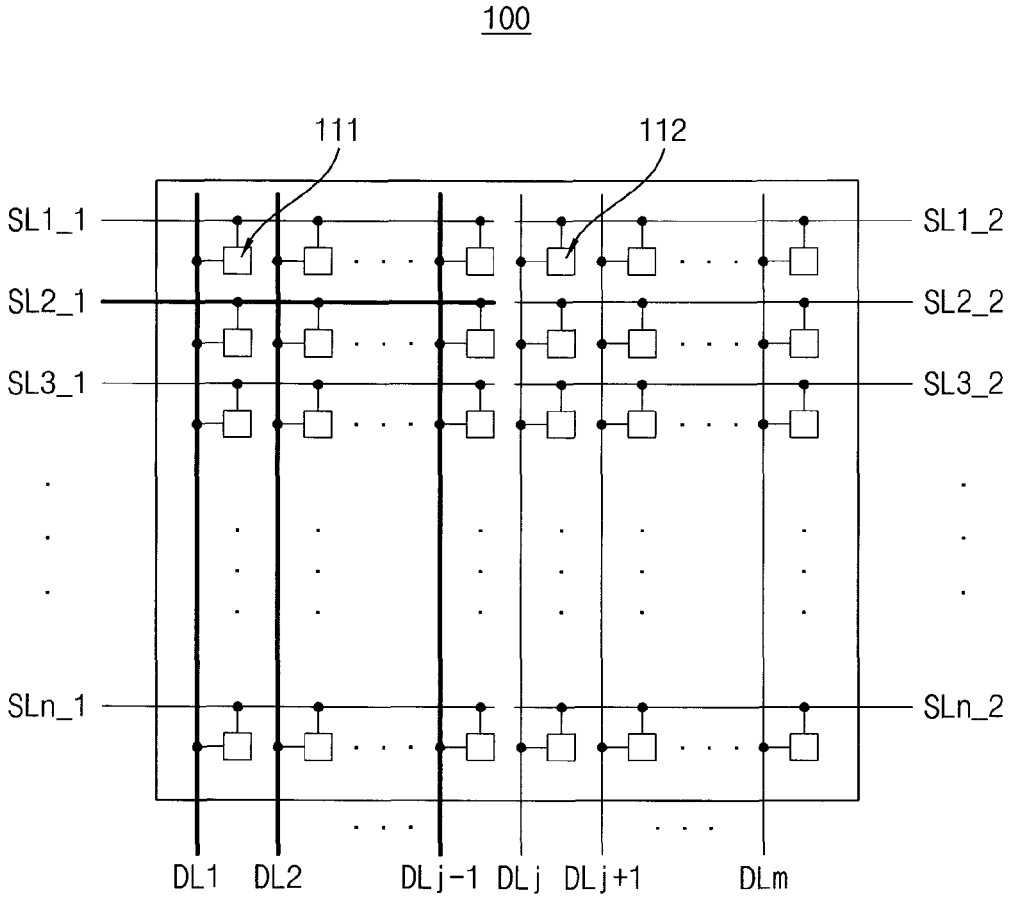

As illustrated in FIG. 5A, the right scan driving unit provides the second scan signal to the right pixel circuits 112 coupled to a first right scan-line SL1_2 via the first right scan-line SL1_2. Thus, the data signal is provided to the right pixel circuits 112 coupled to the first right scan-line SL1_2 via the data-lines DLj through DLm. As illustrated in FIG. 5B, after ½ horizontal period, the left scan driving unit provides the first scan signal to the left pixel circuits 111 coupled to a first left scan-line SL1_1 via the first left scan-line SL1_1. Thus, the data signal is provided to the left pixel circuits 111 coupled to the first left scan-line SL1_1 via the data-lines DL1 through DLj−1. By this operation, the data signal is applied to all pixel circuits 111 and 112 coupled to a first scan-line (i.e., the first left scan-line SL1_1 and the first right scan-line SL1_2) in the display panel 100. As described above, the right scan driving unit sequentially provides the second scan signal to the right scan-lines SL1_2 through SLn_2 at a time interval of one horizontal period. Thus, when the first scan signal is provided to the left pixel circuits 111 coupled to the first left scan-line SL1_1, as illustrated in FIG. 5C, the right scan driving unit provides the second scan signal to the right pixel circuits 112 coupled to a second right scan-line SL2_2 via the second right scan-line SL2_2 after ½ horizontal period. Thus, the data signal is provided to the right pixel circuits 112 coupled to the second right scan-line SL2_2 via the data-lines DLj through DLm. Subsequently, as illustrated in FIG. 5D, after ½ horizontal period, the left scan driving unit provides the first scan signal to the left pixel circuits 111 coupled to a second left scan-line SL2_1 via the second left scan-line SL2_1. Thus, the data signal is provided to the left pixel circuits 111 coupled to the second left scan-line SL2_1 via the data-lines DL1 through DLj−1. By this operation, the data signal is applied to all pixel circuits 111 and 112 coupled to a second scan-line (i.e., the second left scan-line SL2_1 and the second right scan-line SL2_2) in the display panel 100. In this way, scan operations for all pixel circuits 111 and 112 can be completed during one frame.

Figure 6:
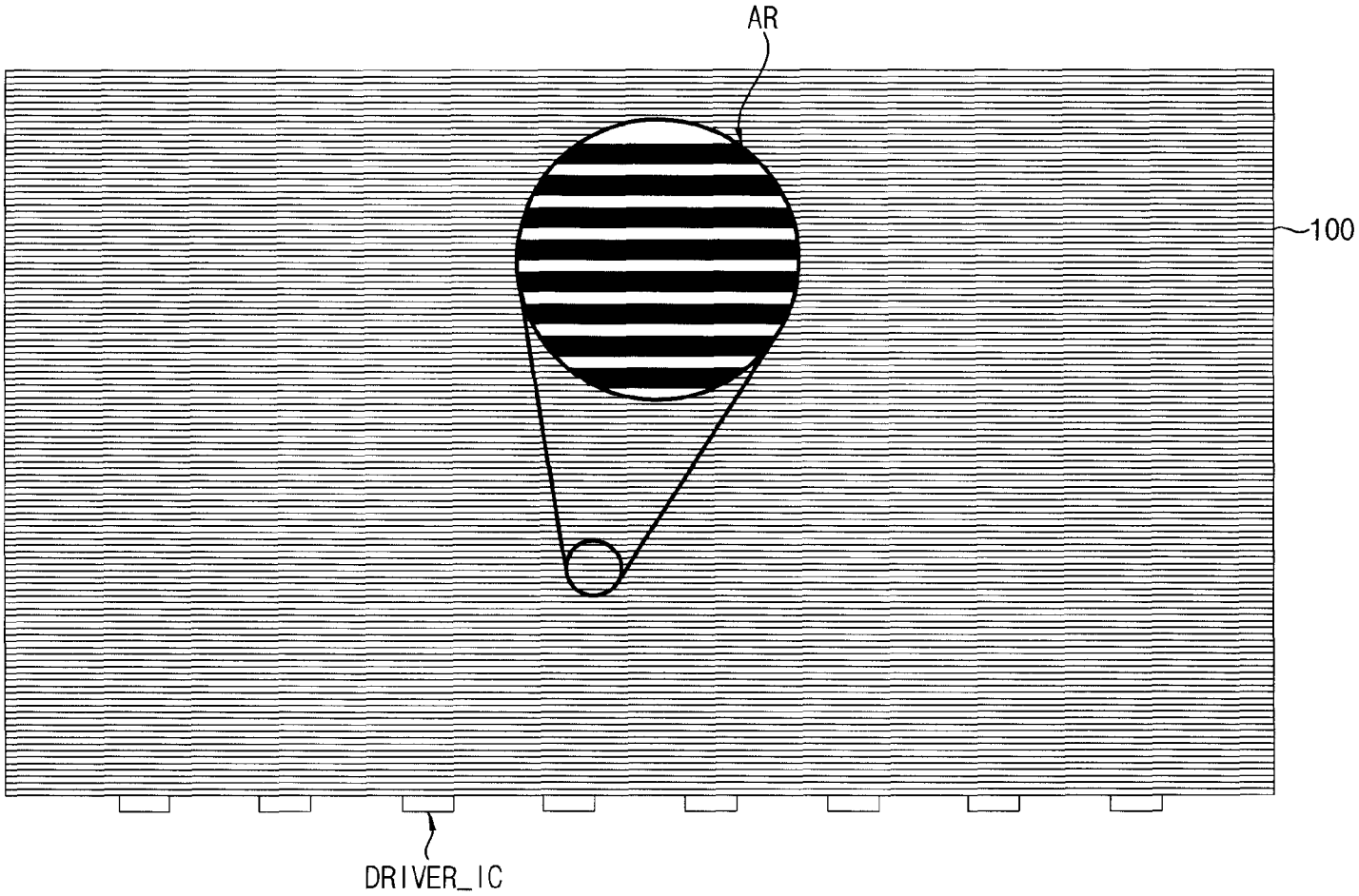
FIG. 6 is a diagram illustrating an example in which a horizontal stripe pattern is displayed on a display panel.
Figure 7:
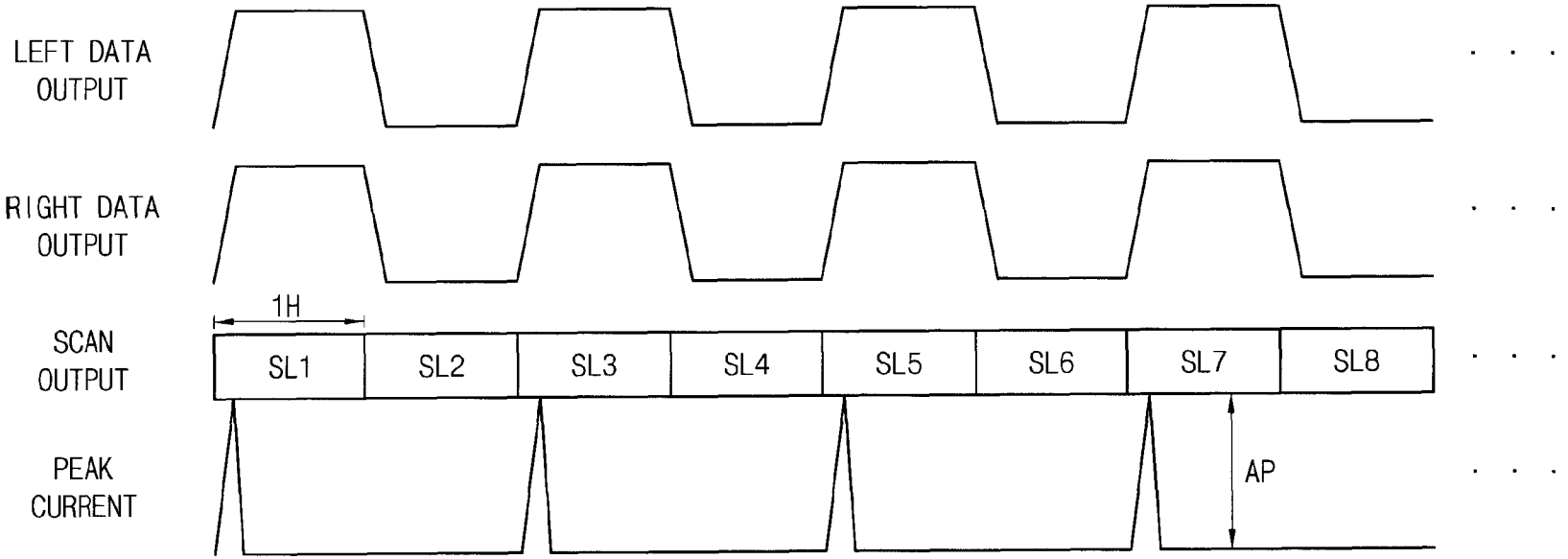
FIG. 7 is a diagram illustrating an example in which a peak current due to a horizontal stripe pattern of FIG. 6 occurs in conventional display panels.
Figure 8:
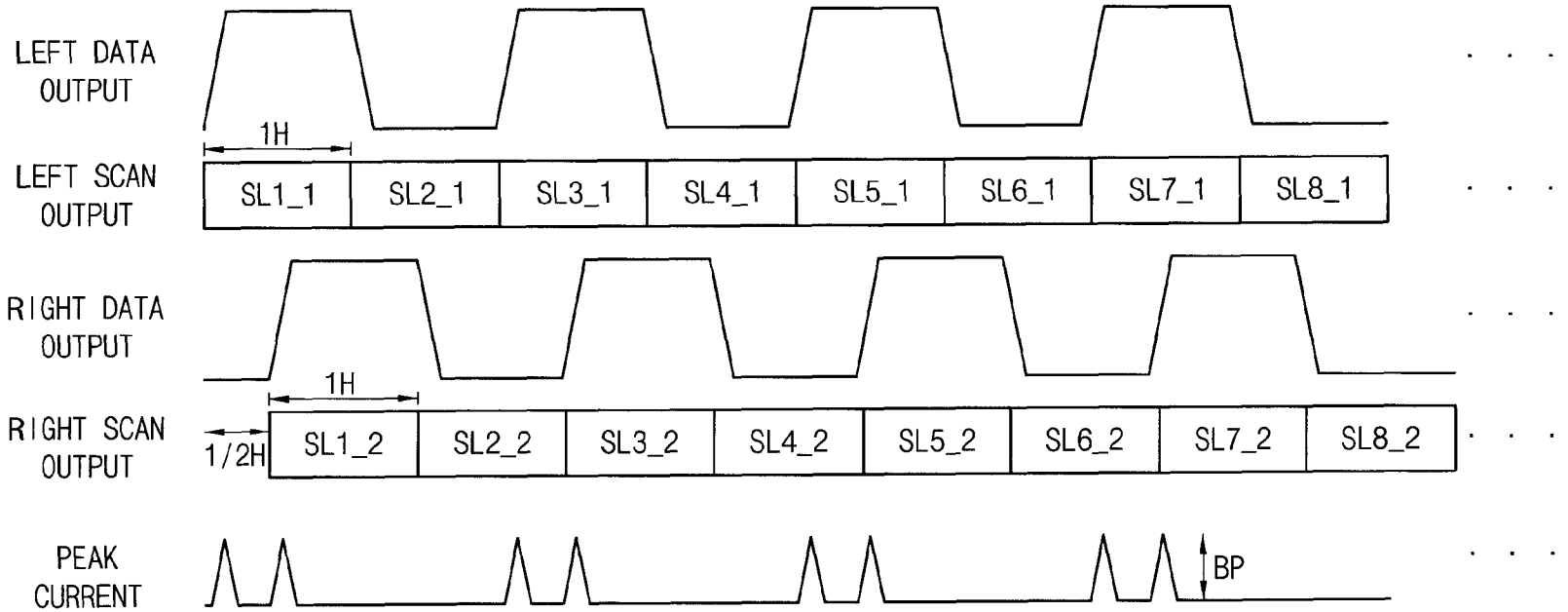
FIG. 8 is a diagram illustrating an example in which a peak current due to a horizontal stripe pattern of FIG. 6 is prevented in a display panel of FIG. 1.

FIG. 6 is a diagram illustrating an example in which a horizontal stripe pattern is displayed on a display panel. FIG. 7 is a diagram illustrating an example in which peak current due to a horizontal stripe pattern of FIG. 6 can occur in conventional display panels. FIG. 8 is a diagram illustrating an example in which peak current caused by the horizontal stripe pattern of FIG. 6 is prevented in a display panel exemplified in various embodiments as depicted in FIG. 1.

Referring to FIG. 6, when the horizontal stripe pattern is displayed on the display panel, a dark (e.g., black) color and a light (e.g., white) color is alternately output along horizontal-lines (e.g., illustrated in a region AR enlarging the horizontal stripe pattern). Thus, a data driver integrated circuit (DRIVER_IC) (illustrated by way of the block at the bottom of the display panel) needs to alternately provide a data signal corresponding to the black and white colors along horizontal-lines as illustrated in FIG. 6. For example, when the data driver integrated circuit DRIVER_IC causes the display of the horizontal stripe pattern, the data signal corresponding to the white color is provided to pixel circuits constituting a first horizontal-line, the data signal corresponding to the black color is provided to pixel circuits constituting a second horizontal-line, and the data signal corresponding to the white color is provided to pixel circuits constituting a third horizontal-line. Since a data writing operation for the pixel circuits constituting one horizontal-line is simultaneously performed in conventional display panels, a wide range of data signal levels is provided to capacitors of the pixel circuits constituting each horizontal-line (i.e., alternately charged and discharged) when one frame having the horizontal stripe pattern is displayed (e.g., black color data and white color data are alternately input along horizontal-lines). As a result, peak current may occur in the data driving integrated circuit DRIVER_IC.

By way of the timing diagram shown in FIG. 7, a peak current due to the horizontal stripe pattern occurs in the conventional display panels. The data writing operation for the pixel circuits constituting one horizontal-line may be simultaneously performed in a conventional display panel because each scan-line is not divided into left and right scan-lines. Thus, when a conventional display panel displays one frame having a horizontal stripe pattern, as illustrated in FIG. 7, the data driving integrated circuit DRIVER_IC provides the data signal corresponding to the white color to all pixel circuits (i.e., left pixel circuits and right pixel circuits) coupled to a first scan-line SL1 as the scan signal is applied to the first scan-line SL1, provides the data signal corresponding to the black color to all pixel circuits coupled to a second scan-line SL2 as the scan signal is applied to the second scan-line SL2, and provides the data signal corresponding to the white color to all pixel circuits coupled to a third scan-line SL3 as the scan signal is applied to the third scan-line SL3. That is, a wide range of data signal levels is provided to capacitors of the pixel circuits (i.e., both the left pixel circuits and the right pixel circuits) constituting a given horizontal-line (i.e., alternately charged and discharged). As a result, a relatively high peak current AP occurs in the data driver integrated circuit DRIVER_IC.

On the other hand, as illustrated by the timing diagram in FIG. 8, a peak current due to the horizontal stripe pattern is prevented in the display panel 100 embodiments as shown, for example, in FIG. 1. The data writing operation for the pixel circuits constituting one horizontal-line are not simultaneously performed in the display panel 100 of FIG. 1 because each scan-line is divided into a left scan-line and a right scan-line. That is, in the display panel 100 of FIG. 1, the data writing operation for the pixel circuits coupled to the left scan-line (i.e., left pixel circuits 111) and the data writing operation for the pixel circuits coupled to the right scan-line (i.e., right pixel circuits 112) are performed with a time delay of ½ horizontal period. Thus, when the display panel 100 of FIG. 1 displays one frame having the horizontal stripe pattern, as illustrated in FIG. 8, the data driving integrated circuit DRIVER_IC provides the data signal corresponding to the white color to the left pixel circuits 111 coupled to a first left scan-line SL1_1 as the first scan signal is applied to the first left scan-line SL1_1, and then provides the data signal corresponding to the white color to the right pixel circuits 112 coupled to a first right scan-line SL1_2 as the second scan signal is applied to the first right scan-line SL1_2. Subsequently, the data driving integrated circuit DRIVER_IC provides the data signal corresponding to the black color to the left pixel circuits 111 coupled to a second left scan-line SL2_1 as the first scan signal is applied to the second left scan-line SL2_1, and then provides the data signal corresponding to the black color to the right pixel circuits 112 coupled to a second right scan-line SL2_2 as the second scan signal is applied to the second right scan-line SL2_2. Next, the data driving integrated circuit DRIVER_IC provides the data signal corresponding to the white color to the left pixel circuits 111 coupled to a third left scan-line SL3_1 as the first scan signal is applied to the third left scan-line SL3_1, and then provides the data signal corresponding to the white color to the right pixel circuits 112 coupled to a third right scan-line SL3_2 as the second scan signal is applied to the third right scan-line SL3_2.

In this way, the data signal is not simultaneously provided to the left pixel circuits 111 and the right pixel circuits 112 constituting a given horizontal-line in the display panel 100 of FIG. 1. Thus, the display panel 100 of FIG. 1 substantially prevents peak current from occurring when a wide range of data signal levels is provided to capacitors of the left pixel circuits 111 and the right pixel circuits 112 constituting each horizontal-line. As illustrated in FIG. 8, a relatively low peak current BP occurs in the data driver integrated circuit DRIVER_IC. As described above, the display panel 100 can reduce interference (e.g., EMI, noise, electro-mechanical stress on components, etc.) caused by peak current by dispersing the peak current across multiple time periods within the scanning of a given horizontal line, as for example, may occur in the data driver integrated circuit DRIVER_IC when a horizontal stripe pattern is displayed. As a result, embodiments of a flat panel display device (e.g., OLED device, LCD device, etc.) having the display panel 100 of FIG. 1 will display a higher-quality image or picture.

Figure 9:
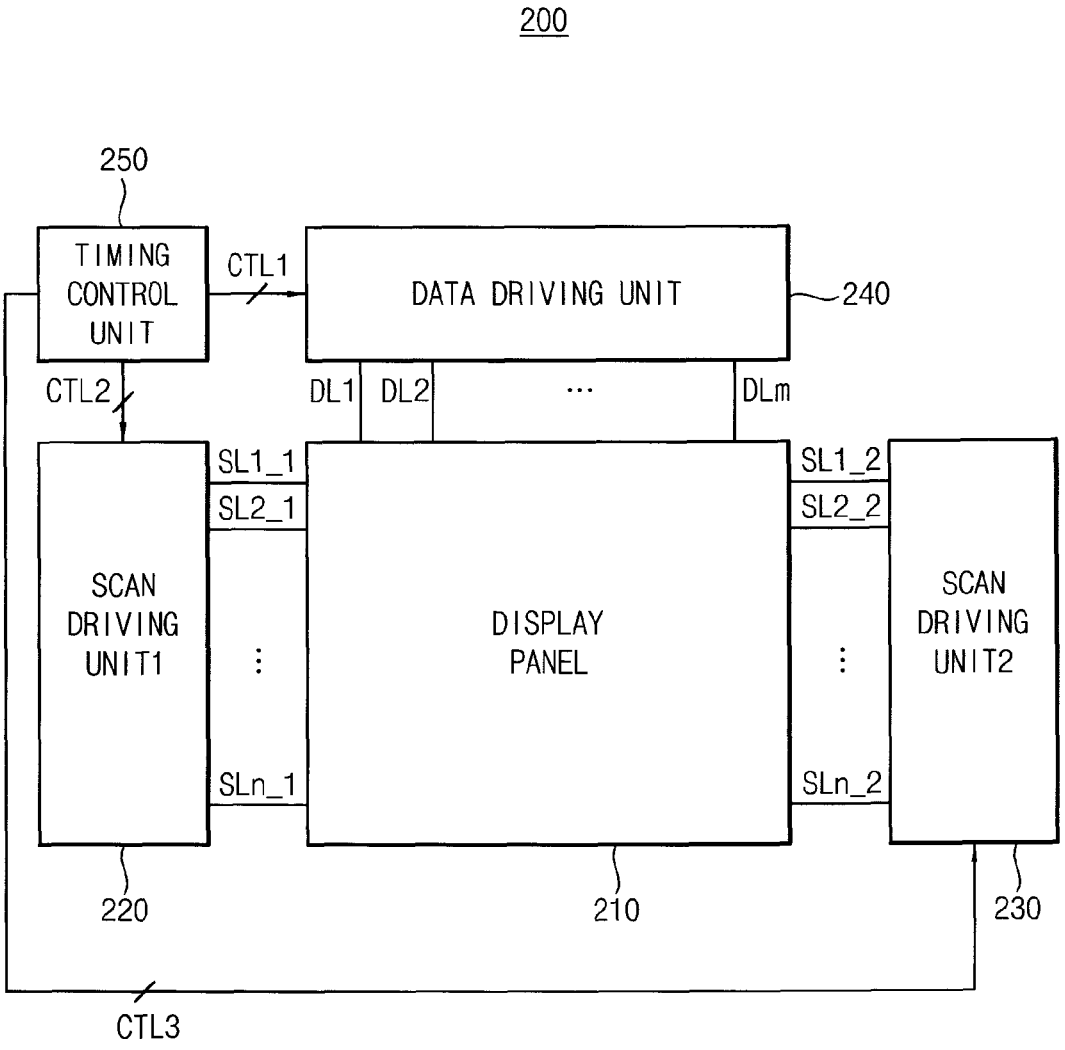
FIG. 9 is a block diagram illustrating a flat panel display device according to example embodiments.

FIG. 9 is a block diagram illustrating a flat panel display device according to example embodiments.

Referring to FIG. 9, embodiments like the flat panel display device 200 include a display panel 210, a left scan driving unit 220, a right scan driving unit 230, a data driving unit 240, and a timing control unit 250.

The display panel 210 includes left pixel circuits and right pixel circuits. Specifically, the left pixel circuits are arranged in a left region of the display panel 210, and the right pixel circuits are arranged in a right region of the display panel 210. The left pixel circuits are coupled to left scan-lines SL1_1 through SLn_1 to receive a first scan signal. The right pixel circuits are coupled to right scan-lines SL1_2 through SLn_2 to receive a second scan signal. The pixel circuits (i.e., the left pixel circuits and the right pixel circuits) are coupled to data-lines DL1 through DLm to receive a data signal. The left scan driving unit 220 provides the first scan signal to the left pixel circuits via the left scan-lines SL1_1 through SLn_1 coupled to the left pixel circuits. The right scan driving unit 230 provides a second scan signal to the right pixel circuits via the right scan-lines SL1_2 through SLn_2 coupled to the right pixel circuits. The data driving unit 240 provides the data signal to the left pixel circuits and the right pixel circuits via the data-lines DL1 through DLm coupled to the left pixel circuits and the right pixel circuits. The timing control unit 250 generates control signals CTL1, CTL2, and CTL3 to provide the control signals CTL1, CTL2, and CTL3 to the data driving unit 240, the left scan driving unit 220, and the right scan driving unit 230. Thus, the data driving unit 240, the left scan driving unit 220, and the right scan driving unit 230 are controlled by the timing control unit 250.

In the flat panel display device 200, the left scan driving unit 220 and the right scan driving unit 230 provide the first scan signal and the second scan signal to the display panel 210 with a predetermined time delay. Here, the predetermined time delay may correspond to a time delay of ½ horizontal period. The left scan driving unit 220 may sequentially apply the first scan signal to the left scan-lines SL1_1 through SLn_1 at a time interval of one horizontal period. The right scan driving unit 230 may sequentially apply the second scan signal to the right scan-lines SL1_2 through SLn_2 at a time interval of one horizontal period. As a result, scan operations for the left pixel circuits and the right pixel circuits constituting respective rows (i.e., respective horizontal-lines) may be sequentially performed in the display panel 210. Accordingly, the data signal may not be simultaneously provided to the left pixel circuits and the right pixel circuits constituting each horizontal-line in the display panel 210. Hence, the display panel 210 prevents peak current from occurring when a wide range of data signal levels is provided to capacitors of the left pixel circuits and the right pixel circuits constituting each horizontal-line (i.e., when a horizontal stripe pattern is displayed). On this basis, embodiments of the flat panel display device 200 display a higher-quality image. In one example embodiment, the flat panel display device 200 may be an OLED device. In this case, the pixel circuits (i.e., the left pixel circuits and the right pixel circuits) of the display panel 210 may have respective organic light emitting diodes. In another example embodiment, the flat panel display device 200 may be an LCD device. In this case, the pixel circuits (i.e., the left pixel circuits and the right pixel circuits) of the display panel 210 may have respective liquid crystal layers. However, a type of the flat panel display device 200 is not limited thereto.

Figure 10:
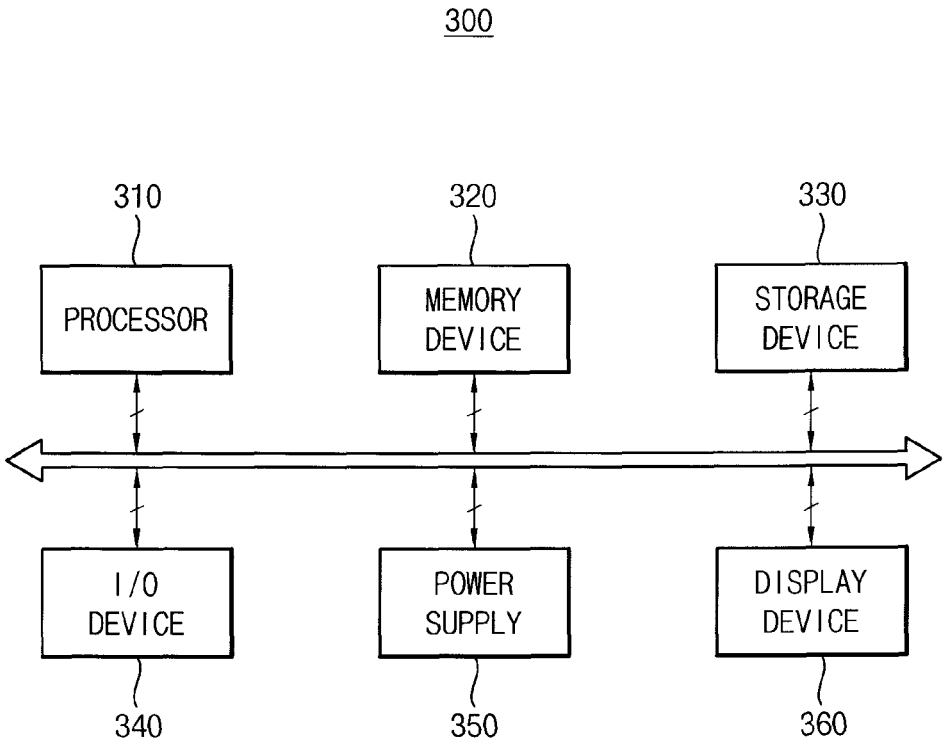
FIG. 10 is a block diagram illustrating an electronic device having a flat panel display device of FIG. 9.

FIG. 10 is a block diagram illustrating an electronic device having a flat panel display device of FIG. 9.

Referring to FIG. 10, embodiments like the electronic device 300 include a processor 310, a memory device 320, a storage device 330, an input/output (I/O) device 340, a power supply 350, and a flat panel display device 360. Here, the flat panel display device 360 may correspond to the flat panel display device 200 of FIG. 9. In addition, the electronic device 300 may further include a plurality of ports for communicating a video card, a sound card, a memory card, a universal serial bus (USB) device, other electronic devices, etc.

The processor 310 may perform various computing functions. The processor 310 may be a microprocessor, a central processing unit (CPU), etc. The processor 310 may be coupled to other components via an address bus, a control bus, a data bus, etc. Further, the processor 310 may be coupled to an extended bus such as a peripheral component interconnection (PCI) bus. The memory device 320 may store data for operations of the electronic device 300. For example, the memory device 320 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 330 may be a solid state drive (SSD) device, a hard disk drive (HDD) device, a CD-ROM device, etc.

The I/O device 340 may be an input device such as a keyboard, a keypad, a touchpad, a touch-screen, a mouse, etc., and an output device such as a printer, a speaker, etc. In some example embodiments, the flat panel display device 360 may be included in the I/O device 340. The power supply 350 may provide a power for operations of the electronic device 300. The flat panel display device 360 may communicate with other components via the buses or other communication links. As described above, the flat panel display device 360 may include a display panel, a left scan driving unit, a right scan driving unit, a data driving unit, and a timing control unit. Here, the display panel of the flat panel display device 360 may have a structure in which left pixel circuits are coupled to the left scan driving unit, right pixel circuits are coupled to the right scan driving unit, and the left pixel circuits and the right pixel circuits constituting each horizontal-line are scanned with a time delay of ½ horizontal period. Hence, the display panel of the flat panel display device 360 may prevent a peak current from occurring when a wide range of data signal is provided to capacitors of the left pixel circuits and the right pixel circuits constituting each horizontal-line (i.e., alternately charged and discharged). As a result, the flat panel display device 360 may display a high-quality image. In some example embodiments, the flat panel display device 360 may correspond to an OLED device or a LCD device. However, a type of the flat panel display device 360 is not limited thereto.

The present inventive concept may be applied to a system having a flat panel display device. For example, the present inventive concept may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A single display panel of a flat panel display device, the display panel comprising:

a plurality of left pixel circuits arranged in a left region of the display panel;

a plurality of right pixel circuits arranged in a right region of the display panel, wherein none of the left pixel circuits are directly connected to any of the right pixel circuits;

a plurality of left scan-lines coupled to the left pixel circuits, the left scan-lines configured to transmit a first scan signal to the left pixel circuits;

a plurality of right scan-lines coupled to the right pixel circuits, the right scan-lines configured to transmit a second scan signal to the right pixel circuits; and a plurality of data-lines coupled to the left pixel circuits and the right pixel circuits, the data-lines configured to transmit a data signal to the left pixel circuits and the right pixel circuits with at least one predetermined delay, wherein the left and right scan lines are configured to respectively transmit the first scan signal and the second scan signal to the left pixel circuits and the right pixel circuits constituting each horizontal-line with the at least one predetermined time delay, wherein the predetermined time delay corresponds to a time delay of ½ horizontal period, wherein the first and second scan signals are respectively sequentially applied to the left and right scan-lines at a time interval of one horizontal period, and wherein the second scan signal has a time delay of ½ horizontal period with respect to the first scan signal in each left scan-line and the corresponding right scan-line.

2. The display panel of claim 1, wherein the flat panel display device corresponds to an organic light emitting display (OLED) device.

3. The display panel of claim 1, wherein the flat panel display device corresponds to a liquid crystal display (LCD) device.

4. The display panel of claim 1, wherein the data lines comprise a plurality of left data lines connected to the left pixel circuits and a plurality of right data lines connected to the right pixel circuits, and wherein none of the left pixel circuits are directly connected to any of the right pixel circuits.

5. A flat panel display device, comprising:

a single display panel having a plurality of left pixel circuits arranged in a left region of the display panel and a plurality of right pixel circuits arranged in. a right region of the display panel, wherein none of the left pixel circuits are directly connected to any of the right pixel circuits;

a left scan driving unit configured to provide a first scan signal to the left pixel circuits via a plurality of left scan-lines coupled to the left pixel circuits;

a right scan driving unit configured to provide a second scan signal to the right pixel circuits via a plurality of right scan-lines coupled to the right pixel circuits;

a data driving unit configured to provide a data signal to the left pixel circuits and the right pixel circuits via a plurality of data-lines coupled to the left pixel circuits and the right pixel circuits with at least one predetermined delay; and a timing control unit configured to control the left scan driving unit, the right scan driving unit, and the data driving unit, wherein the left scan driving unit and the right scan driving unit are configured to provide the first scan signal and the second scan signal to the display panel with the at least one predetermined time delay, wherein the predetermined time delay corresponds to a time delay of ½ horizontal period, wherein the first and second scan signals are respectively sequentially applied to the left and right scan-lines at a time interval of one horizontal period, and wherein the second scan signal has a time delay of ½ horizontal period with respect to the first scan signal in each left scan-line and the corresponding right scan-line.

6. The display device of claim 5, wherein the flat panel display device corresponds to an organic light emitting display (OLED) device.

7. The display device of claim 5, wherein the flat panel display device corresponds to a liquid crystal display (LCD) device.

8. A method of driving a single display panel comprising:

providing a second scan signal to right pixel circuits coupled to a (k)th right scan-line, where k is an integer equal to or greater than 1, with a time delay of ½ horizontal period after a first scan signal is provided to left pixel circuits coupled to a (k)th left scan-line;

providing the second scan signal to right pixel circuits coupled to a (k+1)th right scan-line with the time delay of ½ horizontal period after the first scan signal is provided to left pixel circuits coupled to a (k+1)th left scan-line, wherein none of the left pixel circuits are directly connected to any of the right pixel circuits; and providing a plurality of data-lines coupled to the left pixel circuits and the right pixel circuits, the data-lines configured to transmit a data signal to the left pixel circuits and the right pixel circuits with the time delay of ½ horizontal period, wherein the first scan signal is applied to the (k+1)th left scan-line with the time delay of ½ horizontal period when the second scan signal is applied to the (k)th right scan-line, wherein the first scan signal is applied to the (k+1)th left scan-line with a time delay of one horizontal period when the first scan signal is applied to the (k)th left scan-line, wherein the second scan signal is applied to the (k+1)th right scan-line with a time delay of one horizontal period when the second scan signal is a lied to the (k)th right scan-line and wherein the second scan signal has a time delay of ½ horizontal period with respect to the first scan signal in each left scan-line and the corresponding right scan-line.

9. A method of driving a single display panel, the method comprising:

providing a first scan signal to left pixel circuits coupled to a (k)th left scan-line, where k is an integer equal to or greater than 1, with a time delay of ½ horizontal period after a second scan signal is provided to right pixel circuits coupled to a (k)th right scan-line;

providing the first scan signal to left pixel circuits coupled to a (k+1)th left scan-line with the time delay of ½ horizontal period after the second scan signal is provided to right pixel circuits coupled to a (k+1)th right scan-line, wherein none of the left pixel circuits are directly connected to any of the right pixel circuits; and providing a plurality of data-lines coupled to the left pixel circuits and the right pixel circuits, the data-lines configured to transmit a data signal to the left pixel circuits and the right pixel circuits with the time delay of ½ horizontal period, wherein the second scan signal is applied to the (k+1)th right scan-line with the time delay of ½ horizontal period after the first scan signal is applied to the (k)th left scan-line, wherein the first scan signal is applied to the (k+1)th left scan-line with a time delay of one horizontal period after the first scan signal is applied to the (k)th left scan-line, wherein the second scan signal is applied to the (k+1)th right scan-line with a time delay of one horizontal period after the second scan signal is applied to the (k)th right scan-line, and wherein the second scan signal has a time delay of ½ horizontal period with respect to the first scan signal in each left scan-line and the corresponding right scan-line.

* * * * *